US006561085B1

(12) United States Patent
Durbin et al.

(10) Patent No.: US 6,561,085 B1
(45) Date of Patent: May 13, 2003

(54) SYSTEM AND METHOD FOR VARIABLY ADJUSTING THE PICK-UP LEVEL OF ONE OR MORE WASTE COMPACTOR CONTAINERS

(75) Inventors: Martin J. Durbin, Oak Forest, IL (US); Jay S. Simon, Northbrook, IL (US)

(73) Assignee: One Plus Corp., Northbrook, IL (US)

( * ) Notice: Subject to any disclaimer, the term of this patent is extended or adjusted under 35 U.S.C. 154(b) by 0 days.

(21) Appl. No.: 10/090,244

(22) Filed: Mar. 4, 2002

(51) Int. Cl.[7] ..... B30B 15/16

(52) U.S. Cl. ..... 100/50; 100/99; 100/229 A; 702/188; 340/613; 340/614

(58) Field of Search ..... 100/35, 43, 50, 100/99, 229 A, 229 R; 702/188; 340/613, 614, 626

(56) References Cited

U.S. PATENT DOCUMENTS

| | | | | |
|---|---|---|---|---|
| 3,822,638 A | * | 7/1974 | Merkin | 100/52 |
| 4,643,087 A | * | 2/1987 | Fenner et al. | 100/35 |
| 4,773,027 A | | 9/1988 | Neumann | |
| 5,016,197 A | | 5/1991 | Neumann et al. | |
| 5,173,866 A | | 12/1992 | Neumann et al. | |
| 5,214,594 A | | 5/1993 | Tyler et al. | |
| 5,299,493 A | | 4/1994 | Durbin et al. | |
| 5,303,642 A | | 4/1994 | Durbin et al. | |
| 5,558,013 A | | 9/1996 | Blackstone, Jr. | |
| 5,963,920 A | | 10/1999 | Rose et al. | |
| 5,967,028 A | | 10/1999 | Schomisch et al. | |
| 6,003,441 A | | 12/1999 | Little | |
| 6,021,712 A | | 2/2000 | Harrop | |
| 6,123,017 A | | 9/2000 | Little | |
| 6,148,291 A | | 11/2000 | Radican | |

* cited by examiner

*Primary Examiner*—Allen Ostrager
*Assistant Examiner*—Shelley Self
(74) *Attorney, Agent, or Firm*—Wood, Phillips, Katz, Clark & Mortimer

(57) ABSTRACT

A method and system for remotely managing a network of one or more waste compactor containers, each of which is associated with a monitoring unit and has a set of operating parameters including a container pick-up level. The method and system further allow for the container pick-up level to be variably adjusted based upon one or more preselected conditions. When the present indication of compactor container fullness meets or exceed the presently adjusted pick-up level, a container pick-up request is generated. The variable adjustment of the container pick-up level, generally, takes the form of a setback amount, which alters the amount of compactor container fullness necessary for generating a pick-up request. The setback amount provides an automated approach for handling previously known interruptions or changes in container pick-up services.

14 Claims, 5 Drawing Sheets

SYSTEM AND METHOD FOR VARIABLY ADJUSTING THE PICK-UP LEVEL OF ONE OR MORE WASTE COMPACTOR CONTAINERS

TECHNICAL FIELD

The invention relates generally to waste collection and removal monitoring systems. More particularly, the invention relates to systems and methods for monitoring and managing a number of waste containers, such as trash compactor containers, which are equipped with compacting assemblies, in a manner that permits a user to variably adjust the compactor container fullness level that is used to initiate a container pick-up request, based upon one or more preselected conditions.

BACKGROUND OF THE INVENTION

Traditionally, refuse generators have contracted with waste haulers to pick-up and haul away the accumulated waste. Historically, such contracts have provided for regularly scheduled pick-up times, which occur at pre-specified times, regardless of whether the waste container is full, not yet full, or whether the trash in the waste container has long since been overflowing the container. Trash overflowing from the waste container, being seen as the greater problem, has generally resulted in a pick-up schedule, which assures that most if not all of the regularly scheduled pick-ups occur, when the waste container is not yet overflowing and generally when the waste container is not yet full. As a result a greater number of waste pick-ups are scheduled and subsequently take place earlier than would have been necessary, if the hauler had waited, in each instance, until the waste container was full. The costs associated with the additional refuse pick-ups have largely been passed along and/or are directly paid for by the refuse generator.

Refuse generators are increasingly finding that an economic benefit can be realized by changing from a regular pick-up schedule to an on-demand pick-up schedule. This is despite the fact that, per pick-up, on-demand pick-ups are generally more expensive than regularly scheduled pick-ups, and further despite the fact that there is generally a cost associated with monitoring the waste container to determine when the waste container is full. In most instances the additional costs associated with monitoring the waste container are not enough to offset the expected savings from the reduced number of pick-ups.

In order to monitor the fullness of the waste container, monitoring systems have been used in connection with respective waste containers. Often times the monitoring systems include a corresponding communications link, which allows the monitoring system to communicate to a remote computer. Where the computer is coupled to multiple monitoring systems, the same computer can centrally manage the one or more waste containers. At least one such system for managing trash compactor containers is disclosed in U.S. Pat. No. 5,303,642. Generally, in at least one embodiment of such a system, the amount of force or hydraulic pressure applied to a ram for compacting the trash within the respective container is monitored over the last one or more compaction strokes. The measured force readings are then analyzed and a level of fullness is determined. The determined level of fullness is then compared to a predetermined threshold value, whereupon after the determined level of fullness equals or exceeds the predefined threshold value, the monitoring system initiates a pick-up request.

However, while an above noted cost disparity often exists between on-demand pick-ups versus regularly scheduled pick-ups, the cost of on-demand pick-ups may also vary between pick-ups. The cost may vary for any number of reasons including the time of day or the day of week, that the pick-up is to occur. For example, weekend pick-ups can often times be more expensive than weekday pick-ups. In other instances weekend pick-ups may not even be available. The same is often true regarding holiday pick-ups, in that they are often either unavailable or they are only available at a cost premium.

Some prior systems have attempted to accommodate for periods of unavailability by attempting to predict when the compactor container will become full. These systems in at least one instance take into account a determined present level of fullness and an estimated amount of refuse that will be generated, based upon the actual usage data from one or more historically similar times. A time is then estimated for when the compactor container will be full by determining the amount of unfilled space in the compactor container and then determining the average number of compactions required to fill the remaining space. The estimated number of compactions remaining prior to the compactor container being filled is then compared against an estimate of the upcoming number of necessary compactions, to accommodate the trash generated during a historically similar time. For example a historically similar time might be based upon an average of the usage for the same day of the week during one or more prior weeks.

However methods of predictions of when a trash compactor container will be full, based upon past usage data, are generally not sufficient for the same reason that regularly scheduled pick-ups are not preferred. Namely, refuse is generated in a manner, that is less than predictable. As a result, systems and methods of prediction based upon past usage data is generally insufficient, and similarly fail to take into account varying pick-up rates and pick-up availability.

Consequently, the inventor has recognized it would be beneficial to develop a method or system for managing a waste compactor container network, which minimizes the need for pick-ups during periods of time in which the costs associated with the pick-up are relatively more expensive or may otherwise be unavailable.

SUMMARY OF THE INVENTION

A method is provided for managing a waste compactor container network. The compactor container network includes one or more waste compactor containers, where each compactor container has associated therewith a monitoring unit for monitoring and communicating the status information associated with the compactor container. The method includes receiving the operation parameters for one or more waste compactor containers including a container pick-up level, which when met or exceeded by a current compactor container fullness level, triggers a container pick-up request. One or more preselected conditions and corresponding adjustment amounts are received. A determination is then made if any of the preselected conditions are satisfied. The container pick-up level is then variably adjusted, based upon each of the one or more preselected conditions which are satisfied.

The waste compactor container status information of the one or more compactor containers including an indication of compactor container fullness is then received. The compactor container fullness indication is then compared with the adjusted container pick-up level, and a container pick-up request is initiated, if the compactor container fullness indication equals or exceeds the adjusted container pick-up level.

In further aspects of the invention, the container pick-up level is variably adjusted based upon one or more of the day of the week, the proximity to the weekend, the proximity to a holiday, or the proximity in time to foreseeable changes in the predesignated waste hauler's services or the charge for those services.

In yet a further aspect of the invention, the set of adjustments is applied to a selected group of compactor containers. In at least some instances, the specific compactor containers within the group of compactor containers are selected based upon at least one of the region in which the compactor container is located, the site at which the compactor container is located, the waste hauler with which the compactor container is associated, and the account with which the compactor container is associated.

In a further embodiment, a system is provided for managing a waste compactor container network, which includes one or more waste compactor containers. Each compactor container has an associated monitoring unit for monitoring the status information associated with the compactor container and for communicating the status information. The system provides for a processor for executing a plurality of prestored instructions. The plurality of prestored instructions include instructions for creating and maintaining a compactor container operational parameter database including a container pick-up level for at least one of the waste compactor containers, which triggers a container pick up request. The plurality of instructions further include instructions for variably adjusting the at least one container pick-up level based upon existence of one or more preselected conditions. The plurality of instruction still further include instructions for determining compactor container fullness comprising instructions for receiving the waste compactor container status information including an indication of compactor container fullness and instructions for comparing the indication of compactor container fullness with the adjusted container pick-up level.

In at least one aspect of the invention, the plurality of instruction are stored on a computer readable medium, where the data stored on the medium is accessible to the processor.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
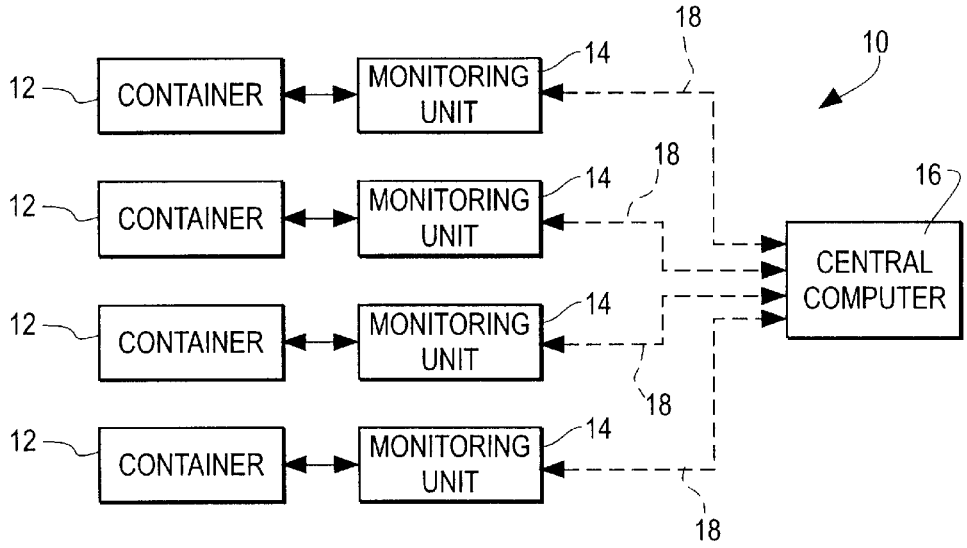
FIG. 1 is a block diagram a waste compactor container network in accordance with the present invention.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a block diagram of an exemplary compactor container network 10 according to at least one embodiment of the present invention. The compactor container network includes one or more waste compactor containers 12, each compactor container having a respective monitoring unit 14. The monitoring units 14 communicate with a central computer 16 via a corresponding communication link 18, which can incorporate wire-based and/or wireless type communication systems. It will be understood by those of ordinary skill in the art that the present invention is applicable to compactor container networks having any number of compactor containers and respective monitoring units. In some instances, the number of compactor containers in a compactor container network can exceed one hundred.

Figure 2:
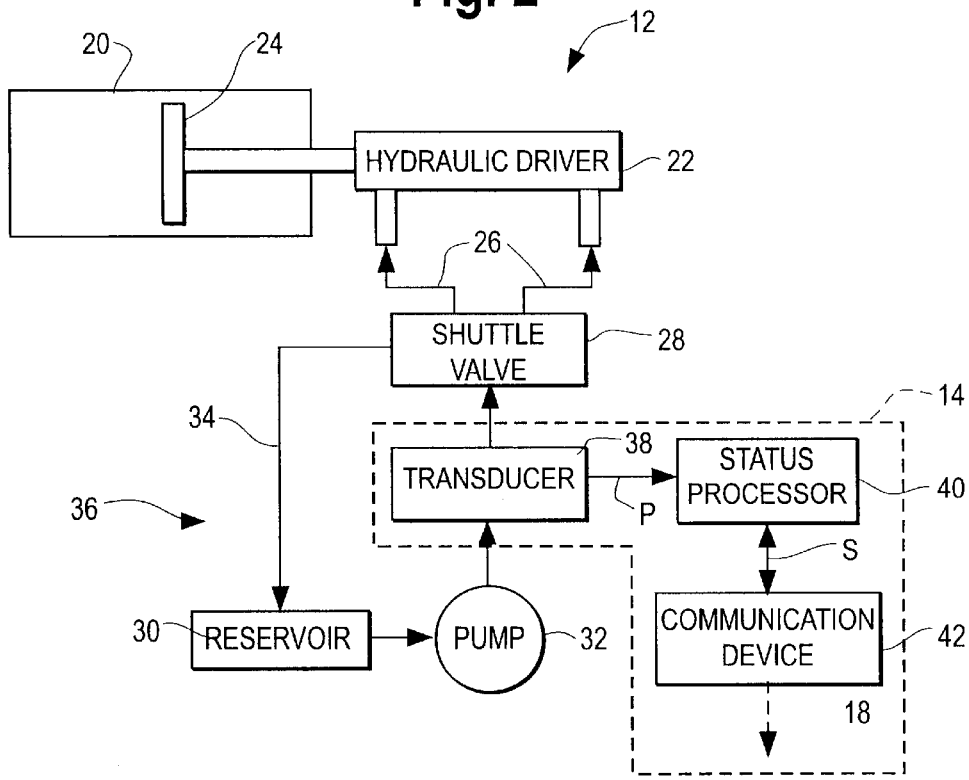
FIG. 2 is a block diagram of one embodiment of a waste compactor container and a corresponding monitoring unit for use in the waste compactor container network illustrated in FIG. 1.

Referring to FIG. 2, a typical waste compactor container, generally depicted by the reference numeral 12, includes a container 20, equipped with a compacting assembly having a hydraulic driver 22 which includes a ram 24, to compact waste received in container 20. The hydraulic driver 22 receives pressurized hydraulic fluid via hydraulic lines 26 to effect reciprocal movement of the ram 24 in a controlled manner using a shuttle valve 28. Hydraulic fluid is stored in a reservoir 30 which under the control of a pump 32 and during the compaction of the waste contents in the container 20, provides pressurized hydraulic fluid to the shuttle valve 28, which is returned from the shuttle valve 28 to the reservoir 30 via a return line 34. As will be recognized by those of ordinary skill, the reservoir 30, pump 32, shuttle valve 28 and return line 34 form a hydraulic circuit 36. The aforementioned compactor container structure is well known in the art and the details thereof are set forth in U.S. Pat. No. 5,303,642, the entire writing and subject matter of which are incorporated herein by reference.

The monitoring unit 14, provides an indication of the status of container 20. For example, the monitoring unit 14 may comprise a pressure transducer 38 disposed in the hydraulic fluid path of the hydraulic circuit 36 at the outlet of the pump 32 to generate a signal (P) indicative of the hydraulic pressure being applied to the hydraulic driver 16. The signal (P) is conveyed to a status processor 40, which preferably includes a microprocessor based computer executing appropriate instructions for determining the compactor container status, based on the signal (P), and generating a compactor container status signal (S), representing status information associated with the compactor container 12.

The monitoring unit 14 may determine the compactor container status locally, and an example of such is similarly disclosed in U.S. Pat. No. 5,303,642. By determining the maximum pressure experienced by the transducer 38 during one or more compaction strokes of the ram 24, the monitoring unit 14 can produce a compactor container status signal (S) representative of the status of the compactor container including the level of fullness. An indication of the level of fullness can be either determined locally and communicated as part of the compactor container status signal (S), or the details of the one or more compaction strokes including the information representative of the hydraulic pressures applied to the hydraulic driver 22 during the compaction stroke can be communicated to a central computer 16 and the compactor container status determined remotely.

The monitoring unit 14 also includes a communication device 42, such as a modem, in communication with the status processor 40, which can communicate to the central computer 16 or another remote computer, through a communication link/interface 18. Communication device 42 conveys the status signal (S) via a communication link 18, which as noted previously may incorporate wire-based type communication system, such as a telephone network, and/or a wireless type communication systems, such as cellular or radio communication networks.

Figure 3:
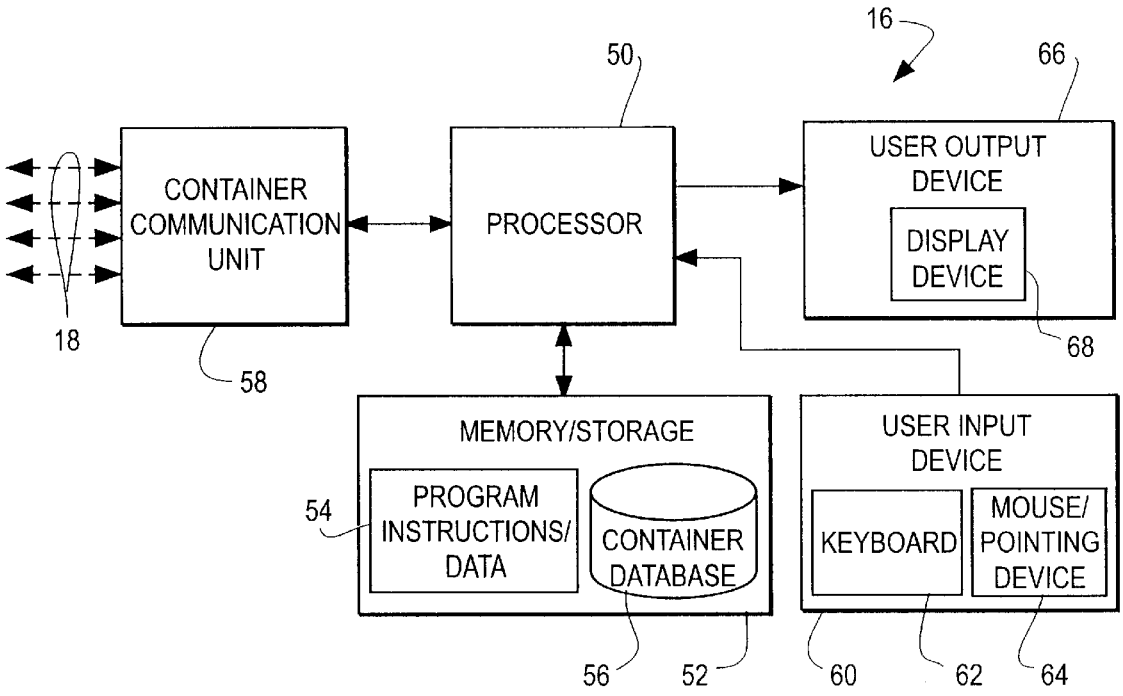
FIG. 3 is a block diagram of a computer for centrally managing one or more waste compactor containers, including waste compactor containers of the type illustrated in FIG. 2, for use in the waste compactor container network, illustrated in FIG. 1.

In at least one embodiment, the central computer 16, as illustrated in FIG. 3, includes a processor 50. The processor 50 is coupled to memory/storage 52, which contains program data and program instructions 54 for use by the processor 50. The memory/storage 52 can take the form of one or more well known forms of memory and/or storage devices and include solid state memory devices, like random access memories (RAM), or read only memories (ROM), and auxiliary storage devices, like optical or magnetic disk storage units. In the illustrated embodiment, the memory/storage 52 further includes the container database structure 56. Generally, the program data and instructions will be stored in a digital format, which can be read or written by the processor 50.

Under the control of the program instructions, the processor 50 will communicate with the monitoring units 14 of the one or more compactor containers 12 via a compactor container communication unit 58 or interface. The compactor container communication unit 58 can take one or more of several well known forms of communication. For example, similar to the communication device 42 of the monitoring unit 14, the compactor container communication unit 58 could include a modem for communicating over a telephone line connection, a radio transceiver for communicating over a wireless communication connection, as well as multiple other well known forms of communication. The specific form of communication of the compactor container communication unit 58, however, should generally be compatible with the form of communication used by the communication device 42. In at least one instance, communication between the compactor container communication unit 58 and the communication device 42 of the monitoring unit 14 can occur via a public global wide area communication network, such as the Internet.

The processor 50 is further coupled to one or more user input devices 60, like a keyboard 62, a mouse 64 or other type of pointing device. The input device could additionally or alternatively include a microphone for receiving voice commands, as well as other well known types of input devices. The user input device 60 facilitates entry of information from a user.

Information is presented to a user via one or more user output devices 66, which are similarly coupled to the processor 50, and which can take one or more well known forms. Examples of user output devices 66 include a display device 68 for visually presenting the information, and/or speakers for audibly presenting the information to the user. In other instances, it may be desirable to have a more permanent visual record of the information, and in these instances a printer could be used to create the more permanent record. In some instances, a touch screen can be used for both presenting information to the user, as well as receiving information.

The central computer 16 generally functions under the control of the programming data and instructions 54 and the input received from the user and the monitoring devices 14, coupled to the compactor containers 12. At least one aspect of the programming data and instructions 54 monitors the compactor container fullness level of the compactor containers 12 and initiates a pick-up request when the compactor container fullness level equals or exceeds a preset container pick-up level. Often times the compactor container fullness level and the container pick-up level correspond to one or more compactor pressure readings measured by the pressure transducer 38 during one or more compaction cycles. Prior to normal, "in service" , operation of the waste compactor container 12, a pressure reading which is indicative of a full compactor container is determined for each waste compactor container 12.

In order to take into account momentary fluctuations in pressure readings, which are contrary to the overall fullness level of the compactor container 12, oftentimes the last couple of pressure readings are analyzed in order to determine the level of fullness of the compactor container. For example, sometimes a blockage, that will clear after a couple of compaction cycles, will cause a temporarily increased pressure reading, that makes the compactor container appear to be more full than it really is.

In some instances, it may be beneficial to initiate a pick-up request prior to the compactor container 12 being full. This may be the case where the rate charged for a pick-up request meaningfully changes for a set period of time or duration. In some of these instances the set period may correspond to a weekend or a particular day, like Sunday. In other instances during the same or similar period, a pick-up may be alternatively unavailable.

If the price difference is significant enough, it may be financially beneficial to initiate a pick-up request prior to the compactor container 12 being full. For example if the price differential for a pick-up request differs by 20 percent between two different pick-up periods, it may be financially beneficial to pick-up a container that is 90 percent full, immediately prior to a transition into the higher rate period, especially where the compactor container is likely to become completely full, before the pick-up rate changes back to the lower pick-up rate. In those instances where pick-up service is interrupted, rather than being available at a premium, an early pick-up may be necessary in order to avoid overspilling or packing out the waste compactor container prior to pick-up service being resumed.

In order to accommodate the unattended management of those instances where a pick-up prior to the compactor container 12 being full is desirable, the present invention allows for selectively variably adjusting the pick-up level of each of the one or more waste compactor containers, based upon one or more preselected conditions.

Examples of preselected conditions can include a particular day of the week, time of day, or the proximity in time to a holiday or a special event. The present system could be further expanded to include more dynamic events, where it might be possible to predict with some degree of certainty an effect on pick-up services, or conditions which might lead to a possible service interruption. Examples of this might include inclement weather conditions, like a weather forecast of a snowstorm, that might prevent the timely execution of a pick-up request. Additional examples may include news of a possible labor strike.

Figure 4:
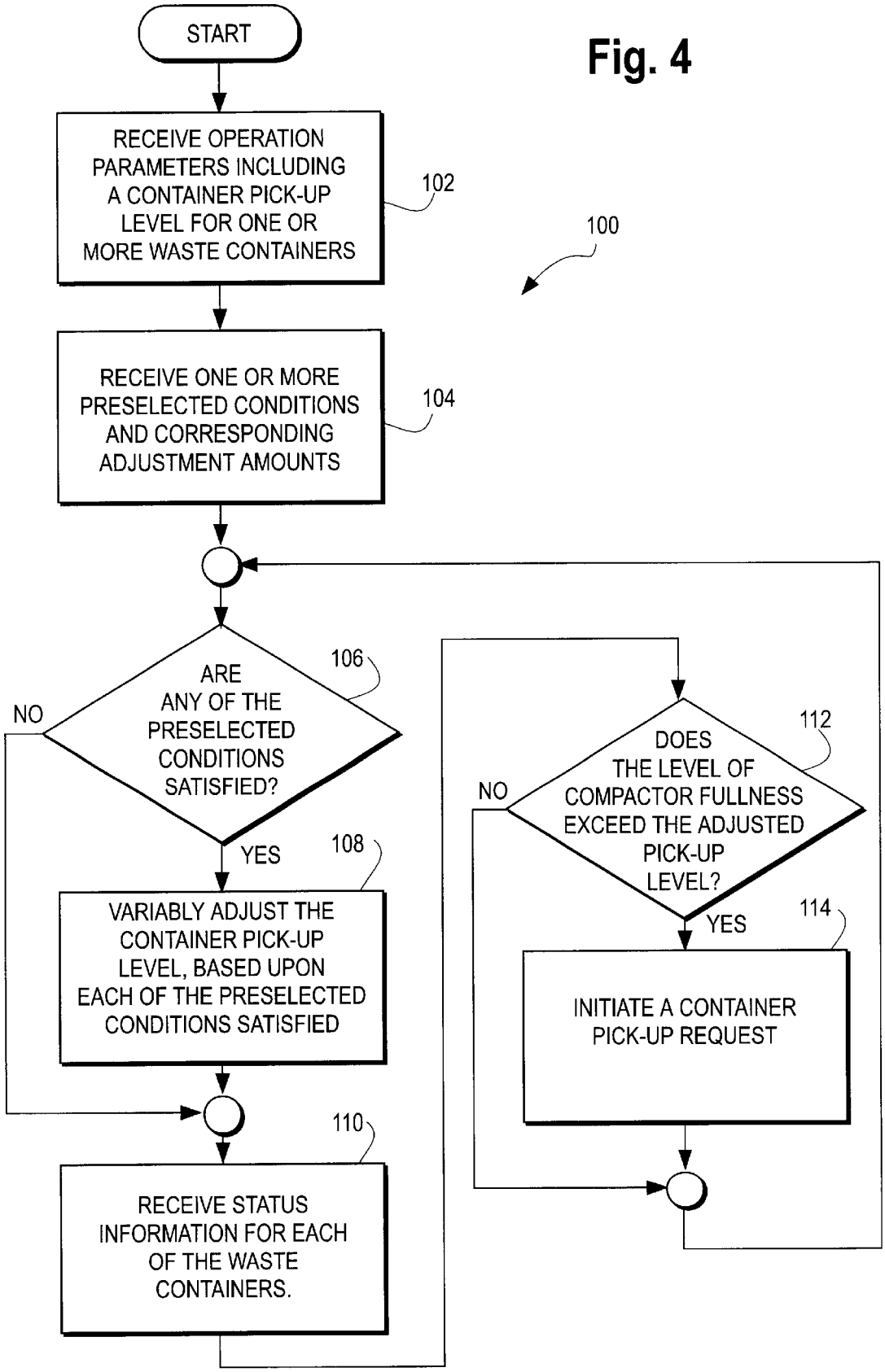
FIG. 4 is a flow diagram for variably adjusting the compactor container fullness level that is used to initiate a container pick-up request being performed by the computer illustrated in FIG. 3.

FIG. 4 illustrates a flow diagram 100 of at least one embodiment for variably adjusting the compactor container fullness level that is used to initiate a container pick-up request, in accordance with the present invention. In at least one embodiment, the flow diagram is implemented using stored programming data and instructions, that are being executed by a computer or processor, like the central computer 16 illustrated in FIG. 3, or the status processor 40 illustrated in FIG. 2.

The waste management system determines the need for a pick-up request by initially receiving operation parameters 102 including a container pick-up level for one or more waste compactor containers 12. As previously noted the container pick-up levels are generally determined for each compactor container 12, individually, depending upon the specifics of the waste compactor container configuration. The management system further receives one or more preselected conditions 104, where it may be desirable to alter the compactor container fullness level at which a pick-up is requested. In addition to the preselected conditions, the management system additionally receives the corresponding amount the pick-up level is to be adjusted, when the preselected condition is satisfied.

A determination is then made 106, whether any of the preselected conditions are satisfied. If any of the preselected conditions are satisfied, the container pick-up level is variably adjusted 108, based upon each of the preselected conditions satisfied.

Status information is then received 110, for each of the waste compactor containers. The status information, including the present level of compactor container fullness, is then compared 112 to the adjusted pick-up level. If the present level of fullness equals or exceeds the adjusted pick-up level, a container pick-up request is initiated 114.

Generally, the adjustment amount for a preselected condition will lower the level of compactor container fullness, that will trigger a pick-up request. However, in some instances it may be desirable to raise the level that will trigger a pick-up request. For example, one such instance may include the period of time immediately prior to the period when the rate charged for a pick-up will transition back down to the lower price level. Where a premium is charged for pick-ups which occur on the weekend, one might want to encourage a pick-up request being initiated on a Friday, by adjusting the pick-up level downward, and discourage a pick-up request being initiated on a Sunday, by adjusting the pick-up level upward.

The adjustment levels can be unique or individually determined for each compactor container. Alternatively, the preselected conditions and corresponding adjustment amounts can be applied and determined with respect to groups of compactor containers. For example, where the desired pick-up level adjustments are being prompted by differences in changes for a particular waste hauler's services, in at least one embodiment it is beneficially possible to define the preselected conditions based upon a grouping that consists of all of the waste compactor containers serviced by the particular hauler.

In other instances compactor container groupings can be organized by region, which may be beneficial for implementation of a pick-up level adjustment, which takes into account weather forecasting.

Figure 5:
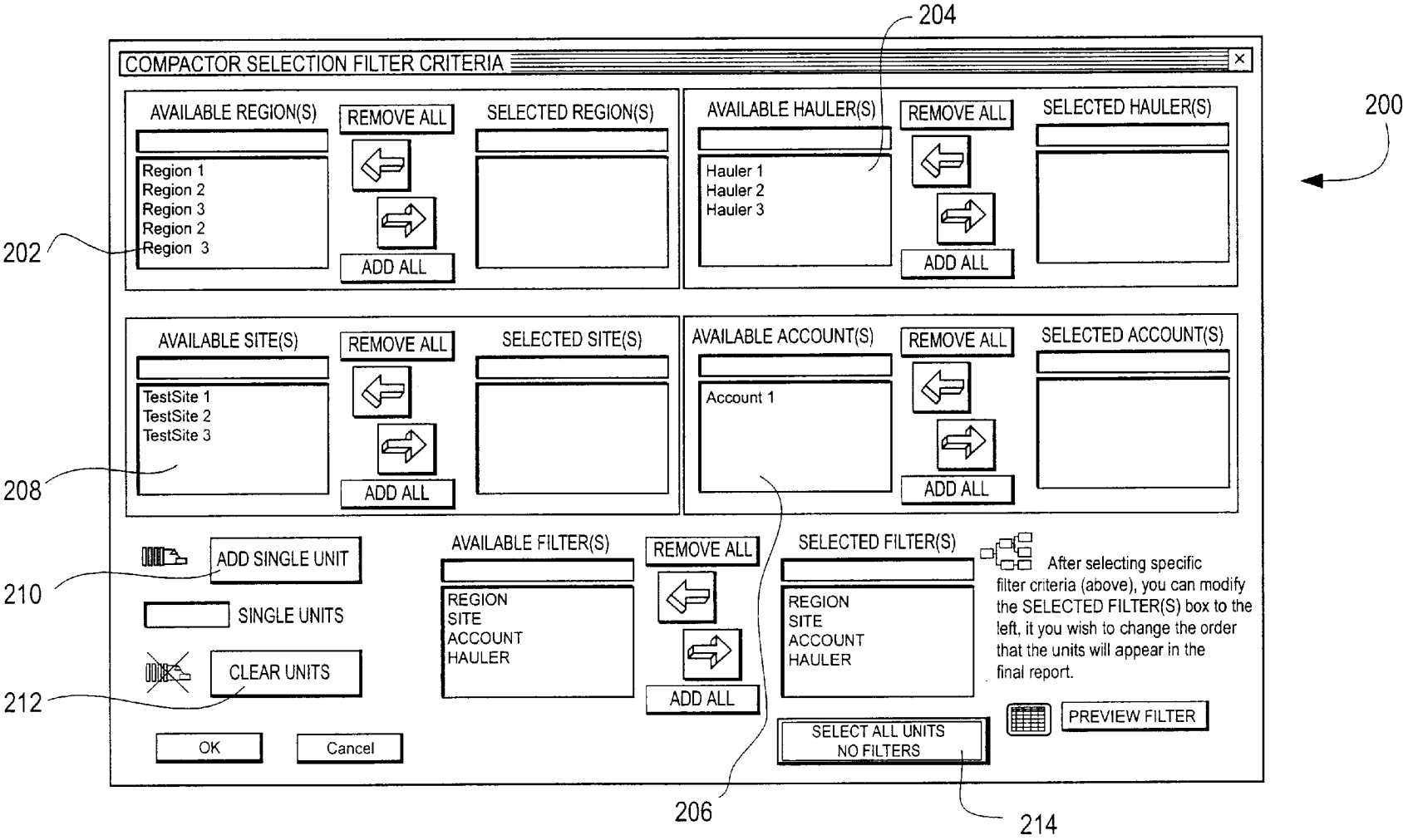
FIG. 5 is an exemplary display for selecting one or more compactor containers and groups of compactor containers for which preselected conditions are to be defined.

FIG. 5 illustrates an exemplary display 200 for selecting one or more compactor containers and groups of compactor containers for which preselected conditions are to be defined. The exemplary display is broken down into multiple areas, including several areas which include different sets of groupings based upon various criteria. One area 202 groups the waste compactor containers by region. Another area 204 groups the waste compactor containers by hauler. Yet another area 206 groups the waste compactor containers by account . Yet another further area 208 defines separate test site groups of waste compactor containers.

It is further possible to individually add 210 or delete 212 a waste compactor container, to or from a selected group, for which preselected conditions are going to be defined. A further feature 214 allows for all of the compactor containers, for which preselected conditions have not yet been defined, to be selected.

Figure 6:
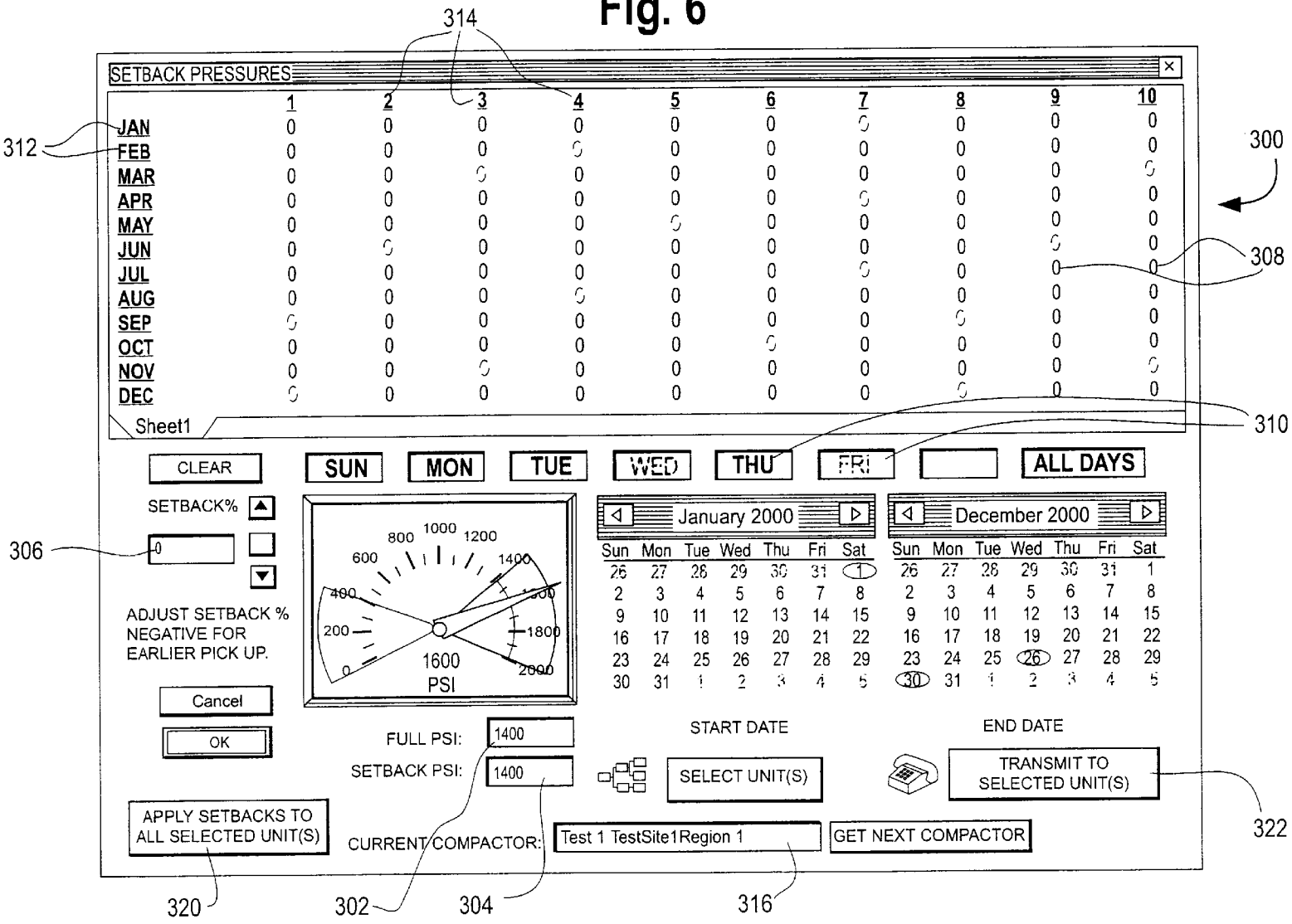
FIG. 6 is an exemplary display for entering a pick-up level adjustment amounts to be applied to the one or more compactor containers selected in FIG. 5, when an identified preselected conditions exists.

Once the particular waste compactor containers are selected, the preselected conditions and the corresponding adjustment amounts can be defined. FIG. 6 illustrates an exemplary display 300 for entering a pick-up level adjustment amounts to be applied to the one or more compactor containers selected in FIG. 5, when an identified preselected condition exists. Where appropriate, the non-adjusted level 302 for initiating a pick-up can be displayed, as well as the adjusted level 304 after application of the appropriate adjustments.

In at least one embodiment, the adjustment amounts 306 are defined in terms of a percentage. Applying adjustment amounts 306 as a percentage may be useful, especially when the adjustment amounts are being defined for a group of compactor containers, which have different non-adjusted pick-up levels.

The particular adjustment display 300 allows for preselected conditions to be defined based upon a specific individual day 308, a particular day of the week 310, a particular month 312, or a particular day of the month 314. As noted previously, defining adjustment amounts based upon other types of preselected conditions may be desirable including preselected condition based upon weather forecasts or labor conditions.

The preselected conditions and corresponding adjustment amounts can be individually applied to each of the units 318, or alternatively applied to all of the selected units 320. Once the preselected conditions and corresponding adjustment amounts have been defined, they can be transmitted 322 to the selected units.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A method of managing a waste compactor container network, the compactor container network including one or more waste compactor containers, each compactor container having associated therewith a monitoring unit for monitoring and communicating the status information associated with the compactor container, the method comprising:

receiving operation parameters for one or more waste compactor containers including a container pick-up level, which when met or exceeded by a current compactor container fullness level triggers a container pick-up request;

receiving one or more preselected conditions and corresponding adjustment amounts, which are applied to the container pick-up level if the preselected conditions are satisfied;

determining if any of the preselected conditions are satisfied;

variably adjusting the container pick-up level based upon each of the one or more preselected conditions which are satisfied;

receiving the waste container status information of the one or more compactor containers including an indication of compactor container fullness;

comparing the indication of compactor container fullness with the adjusted container pick-up level; and initiating a container pick-up request if the compactor container fullness indication equals or exceeds the adjusted container pick-up level.

2. A method in accordance with claim 1, wherein variably adjusting the container pick-up level includes variably adjusting the container pick-up level based upon the day of the week.

3. A method in accordance with claim 1, wherein variably adjusting the container pick-up level includes variably adjusting the container pick-up level based upon the proximity in time to a weekend.

4. A method in accordance with claim 1, wherein variably adjusting the container pick-up level includes variably adjusting the container pick-up level based upon the proximity in time to a holiday.

5. A method in accordance with claim 1, wherein initiating a container pick-up request includes transmitting a pick-up request to one of one or more predesignated waste haulers associated with the waste container whose compactor container fullness indication equals or exceeds the adjusted container pick-up level.

6. A method in accordance with claim 5, wherein variably adjusting the container pick-up level includes variably adjusting the container pick-up level based upon the proximity in time to foreseeable changes in the predesignated waste haulers'service.

7. A method in accordance with claim 5, wherein variably adjusting the container pick-up level includes variably adjusting the container pick-up level based upon the proximity in time to foreseeable changes in the weather and corresponding disruptions in a predesignated waste hauler's service.

8. A method in accordance with claim 1, wherein variably adjusting the container pick-up level includes variably adjusting the container pick-up level for a selected group of containers.

9. A method in accordance with claim 8, wherein the compactor containers within the group of compactor containers are selected based upon at least one of the region in which the compactor container is located, the site at which the compactor container is located, the waste hauler with which the compactor container is associated, and the account with which the compactor container is associated.

10. A method in accordance with claim 1, wherein variably adjusting the container pick-up level includes variably adjusting the container pick-up level an amount corresponding to a percentage of an unadjusted pick-up level.

11. A system for managing a waste compactor container network, the compactor container network including one or more waste compactor containers, each compactor container having associated therewith a monitoring unit for monitoring the status information associated with the compactor container and communicating the status information, the system comprising:

a processor for executing a plurality of prestored instructions including instructions for creating and maintaining a compactor container operational parameter database including a container pick-up level for at least one of the waste compactor containers, which triggers a container pick up request, instructions for variably adjusting the at least one container pick-up level based upon existence of one or more preselected conditions, and instructions for determining compactor container fullness comprising instructions for receiving the waste compactor container status information including an indication of compactor container fullness and instructions for comparing the indication of compactor container fullness with the adjusted container pick-up level.

12. A system in accordance with claim 11, wherein the processor is part of the monitoring unit.

13. A system in accordance with claim 11, wherein the processor is part of a central computer coupled to each of the monitoring units.

14. A system for managing a waste compactor container network, the compactor container network including one or more waste compactor containers, each compactor container having associated therewith a monitoring unit for monitoring the status information associated with the compactor container and communicating the status information, the system comprising:

a computer comprising a computer readable medium for storing computer readable instructions and data thereon, and a processor for executing the plurality of instructions stored on the computer readable medium, the computer readable medium including instructions for creating and maintaining a compactor container operational parameter database including a container pick-up level for at least one of the waste compactor containers, which triggers a container pick up request, instructions for variably adjusting the at least one container pick-up level based upon the existence of one or more preselected conditions, and instructions for determining compactor container fullness including instructions for receiving the waste compactor container status information including an indication of compactor container fullness and comparing the compactor container fullness information with the adjusted container pick-up level.

* * * * *